United States Patent [19]

Pohl et al.

[11] Patent Number: 4,955,457

[45] Date of Patent: Sep. 11, 1990

[54] ARRANGEMENT FOR THE DEMOLITION OF SMOKESTACKS

[75] Inventors: Reinhold Pohl; Manfred Dresselmann, both of Ruhr; Hans-Wilhelm Hessmann, Gelsenkirchen, all of Fed. Rep. of Germany

[73] Assignee: Robota GmbH Feuerungs- und Schornsteinbau, Mülheim a.d. Ruhr, Fed. Rep. of Germany

[21] Appl. No.: 440,900

[22] Filed: Nov. 22, 1989

[30] Foreign Application Priority Data

Nov. 24, 1988 [DE] Fed. Rep. of Germany ..... 3839677

[51] Int. Cl.[5] ..... E04G 3/10; E04G 23/08; E04H 12/34

[52] U.S. Cl. ..... 182/128; 182/142

[58] Field of Search ..... 182/128, 150, 142, 143, 182/144, 136; 299/70, 69, 42

[56] References Cited

U.S. PATENT DOCUMENTS

| | | | |
|---|---|---|---|
| 1,218,008 | 3/1917 | Smith | 182/128 |
| 1,652,403 | 12/1927 | Gerdeman | 182/128 |
| 2,221,133 | 11/1940 | Gladville | 182/128 |
| 2,710,418 | 6/1955 | Putnam | 182/128 |
| 3,198,285 | 8/1965 | Nerlich | 182/128 |
| 3,346,300 | 10/1967 | Grant | 182/128 |
| 3,370,888 | 2/1968 | Skendrovic | 182/128 |
| 4,068,895 | 1/1978 | Keese | 182/128 |
| 4,407,392 | 10/1983 | Lazzari | 182/128 |
| 4,607,994 | 8/1986 | Jacobsson | 182/128 |
| 4,861,112 | 8/1989 | Grant | 182/128 |

*Primary Examiner*—Reinaldo P. Machado
*Attorney, Agent, or Firm*—Toren, McGeady & Associates

[57] ABSTRACT

An arrangement for the demolition of smokestacks includes a demolition tool for successively demolishing the smokestack shaft. A work platform is suspended from the smokestack wall by suspension devices distributed over the circumference of the work platform. Each suspension device includes at least one vertically guided lowering piston which can be locked in different vertical positions. A suspension arm is mounted at the upper end of each piston and can be swung inwardly and outwardly. In the outwardly swung position, the suspension arm engages over the smokestack wall. A mechanical shovel with the demolition tool works on the work platform. The demolition is carried out in the area of a suspension arm which is swung inwardly. After the demolition work has been carried out, the suspension arm is again moved to the outwardly swung position. This is repeated with all suspension arms until the work platform can be lowered by the stroke of the lowering piston and a new demolition cycle can begin.

23 Claims, 5 Drawing Sheets

Fig.3
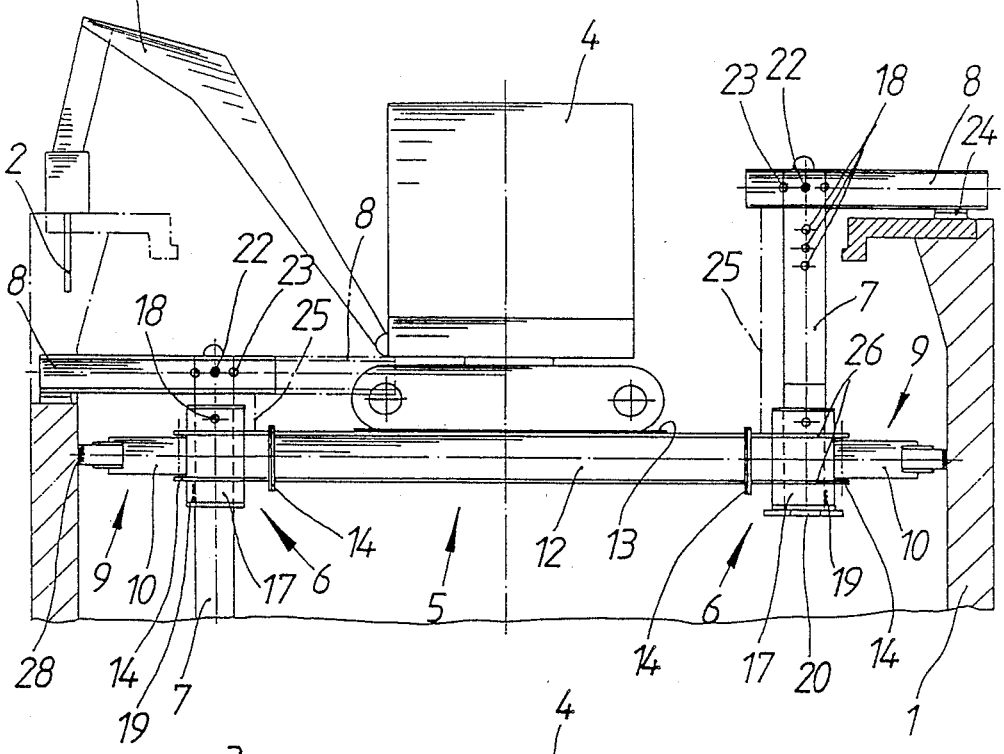
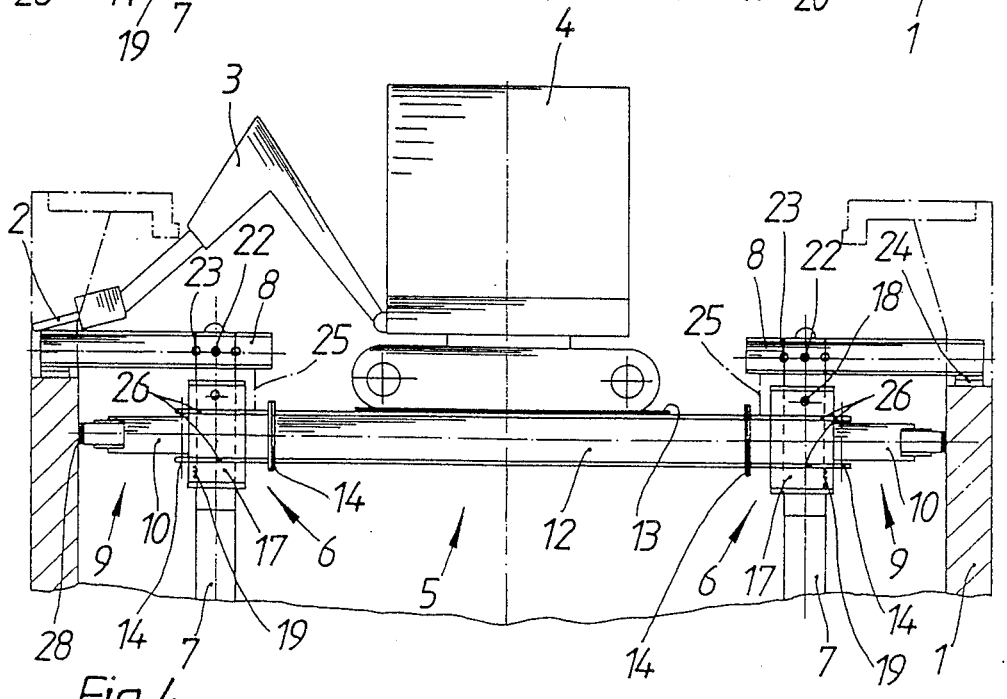
Fig.4

ARRANGEMENT FOR THE DEMOLITION OF SMOKESTACKS

BACKGROUND OF THE INVENTION

1. Field of the Invention

The present invention relates to a arrangement for the demolition of smokestacks, particularly tall smokestacks, of masonry, concrete or reinforced concrete. The arrangement includes a demolition tool for successively demolishing the smokestack shaft from the head to the base of the smokestack.

2. Description of the Related Art

The demolition of smokestacks is always problematic, particularly in case of free-standing industrial smokestacks of great height. It is frequently necessary just for safety reasons to carry out a manual demolition, particularly by means of manually operated demolition devices, such as, pneumatic hammers or the like.

A mechanized demolition has also been attempted in the past. For this purpose, a mechanical shovel with cantilever legs is placed on the smokestack shaft by means of a hoist structure which is initially installed on the smokestack head. The shovel boom is equipped with a demolition tool. The demolition tool is used for successively removing masonry and concrete, while in the case of reinforced concrete structures the reinforcement steel is additionally cut by means of a cutting torch or the like which is operated from a bracket structure. The shovel travels with the demolition progress from the smokestack head to the smokestack base. The cantilever legs follow the demolition progress on the smokestack wall. Since there is substantial danger that the shovel falls down, the shovel must additionally be suspended from a crane. The use of such a crane is very expensive. Moreover, cranes having a sufficient boom length are frequently not even available. Thus, the above-described known demolition method is not satisfactory.

It is, therefore, the primary object of the present invention to provide an arrangement of the above-described type which makes possible a mechanized demolition of smokestacks, and particularly of tall smokestacks, with optimum safety and in an uncomplicated and inexpensive manner.

SUMMARY OF THE INVENTION

In accordance with the present invention, an arrangement of the above-described type includes a work platform which can be placed into the smokestack shaft at the top end thereof. Specifically, the work platform is mounted by means of suspension devices which are distributed over the circumference of the work platform. Each suspension device includes at least one vertically guided lowering piston which can be locked in different vertical positions. A suspension arm is mounted at the upper end of each piston and can be swung inwardly and outwardly. In the outwardly swung position, the suspension arm engages over the smokestack wall. The invention further provides that the work platform has support devices distributed over the circumference of the work platform. Each support device has a support arm which can be brought into contact with the inner wall of the smokestack.

The invention is based on the finding that a mechanical shovel with a demolition tool can be used for the demolition of smokestacks with sufficient freedom of movement and optimum safety if a work platform is installed for the mechanical shovel which can be lowered step by step in accordance with the demolition progress from the head to the base of the smokestack. Such a work platform can be lifted in the same manner as the mechanical shovel by means of an approved hoist structure to the level of the top end of the smokestack and can there be suspended in the smokestack shaft. The work platform is suspended from the smokestack wall by means of the suspension devices which are provided distributed over the circumference thereof. At this stage, the lowering pistons are extended, i.e., the work platform is suspended at the lower end of the lowering pistons and the suspension arms engage over the smokestack wall. During the demolition operation, the suspension arms are individually and successively swung in and out, so that demolition of the smokestack wall can be carried out down to a short distance above the level of the work platform. Subsequently, the respective lowering piston is moved downwardly by the extent of the demolition progress and the respective suspension arm is again swung outwardly, so that it then engages over the smokestack wall at the lower demolition location.

The above-described procedure is repeated at each suspension arm and lowering piston around the work platform which usually has a polygonal circumference, so that finally all lowering pistons with their suspension arms are retracted or lowered by the degree of the demolition progress. Thus, the degree of the demolition progress corresponds to the maximum piston stroke. After a demolition cycle, all lowering pistons are in the retracted position and the work platform is in the region of the upper ends of the lowering pistons. The work platform is now lowered by the extent of the piston stroke and, in the lowered position, is again at the lower end of the lowering pistons, so that a new demolition cycle can be carried out and the smokestack wall can be demolished around the work platform by the extent of the stroke, etc. The support devices which can be moved toward the inner wall of the smokestack have the purpose to center the work platform in the smokestack shaft and to secure it against swinging movements. During the lowering of the work platform, the support devices are temporarily separated and, thus, moved away from the inner wall of the smokestack. An entirely secured work platform is always available for the mechanical shovel, so that the demolition work can be carried out mechanically and efficiently without requiring an additional suspension from a crane.

In accordance with an important feature of the present invention, the support devices are arranged in radial extension to the suspension devices and the suspension devices together with the support devices can be moved forward or forepoled in radial direction with the intermediate arrangement of cantilever arms. This makes possible an adjustment to different smokestack diameters. This is particularly important since the smokestack diameter usually increases from the smokestack head to the smokestack base.

The cantilever arms may be sectional girders, rack and pinion gear systems or cylinder piston arrangements with screwable connecting flanges. Also, it is possible to connect several successive sectional girders through their connecting flanges and to mount them between the suspension devices and/or platforms. Further, walkways may be fastened on the cantilever arms and catch nets can be arranged between the cantilever arms, so that additional security is provided for the demolition personnel.

In accordance with a proposal of the invention with independent significance, each of the suspension devices has a guide tube for the lowering piston, wherein the guide tube is flanged in vertical direction directly to the work platform or to an intermediately arranged cantilever arm. The lowering piston is mounted vertically adjustable and lockable in the guide tube. At predetermined vertical distances, the guide tube and the lowering piston have aligned transverse bores for the insertion of locking bolts. In this manner, the extent of the demolition progress can be varied over the height of the piston strokes, so that the work platform has to be lowered only after several demolition steps have been carried out over the circumference of the smokestack. Moreover, this construction of the suspension devices is particularly simple, stable and functionally practical with respect to the manufacture and operation. This is also true for another feature of the invention which provides that the guide tube is a rectangular tube and the lowering piston is an I-section and that arranged in the guide tube are longitudinal guides, for example, ball guides or roller guides as ladder-shaped flat cages or roller carriages for the lowering piston. In this manner, it is ensured that each lowering piston can easily travel in the guide tube. In particular, tilting of the lowering piston is avoided.

Each lowering piston advantageously has at its lower end a base plate serving as a stop for the guide tube and, thus, for the work platform and the lowering piston has suspension eyes at its upper end. These suspension eyes are also provided on the work platform, so that the work platform can be suspended from a hoist structure in the smokestack openings. The vertically guided lowering piston preferably has at its upper end two horizontal bearing jaws and the suspension arm is pivotably supported between these bearing jaws on a horizontal bearing bolt. The suspension arm is lockable in horizontal position by means of locking bolts which can be inserted in aligned transverse bores on one side or on both sides of the bearing bolt. The bearing jaws and the suspension arm may be U-sections. Each suspension arm may have at its end resting on the smokestack wall a vertically adjustable support plate in order to achieve a problem-free support on the demolition surface of the smokestack shaft.

In accordance with another proposal of the invention, which is also of independent significance in combination with the above-mentioned features, the inner ends of the suspension arms and the guide tubes are connected to each other in the area of their inner connecting flanges by means of chain hoists or rope hoists and, thus, the work platform is lowerable on the suspended lowering pistons by means of chain hoist or rope hoist devices. This lowering of the work platform is required prior to each demolition cycle. The lowered work platform then rests on the base plates of the lowering pistons and is additionally braced relative to the inner wall of the smokestack.

Another feature of the present invention provides that each guide tube is surrounded by a double collar with connecting flange for the work platform or the intermediately arranged cantilever arm and that one or two support arms are mounted between the two collars so as to be swivelable in a horizontal plane. The one or two support arms are fixable in a position in which they rest against the inner wall of the smokestack, for example, by means of a chain hoist or lever system connecting the two support arms, so that the support arms cannot pivot independently resulting in a loss of the support. To ensure a good support or adjustment to the inner wall of the smokestack, the support arms may have at the ends thereof support plates which are mounted pivotably or in an articulated manner.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 3 is a vertical sectional view corresponding to FIG. 1 shown after a portion of the smokestack wall has been demolished in the area of a suspension arm which has been swung out, wherein the swung-in position of the suspension arm is shown in broken lines;

FIG. 4 is a vertical section view corresponding to FIG. 3 after a demolition cycle;

DESCRIPTION OF THE PREFERRED EMBODIMENT

Figure 1:
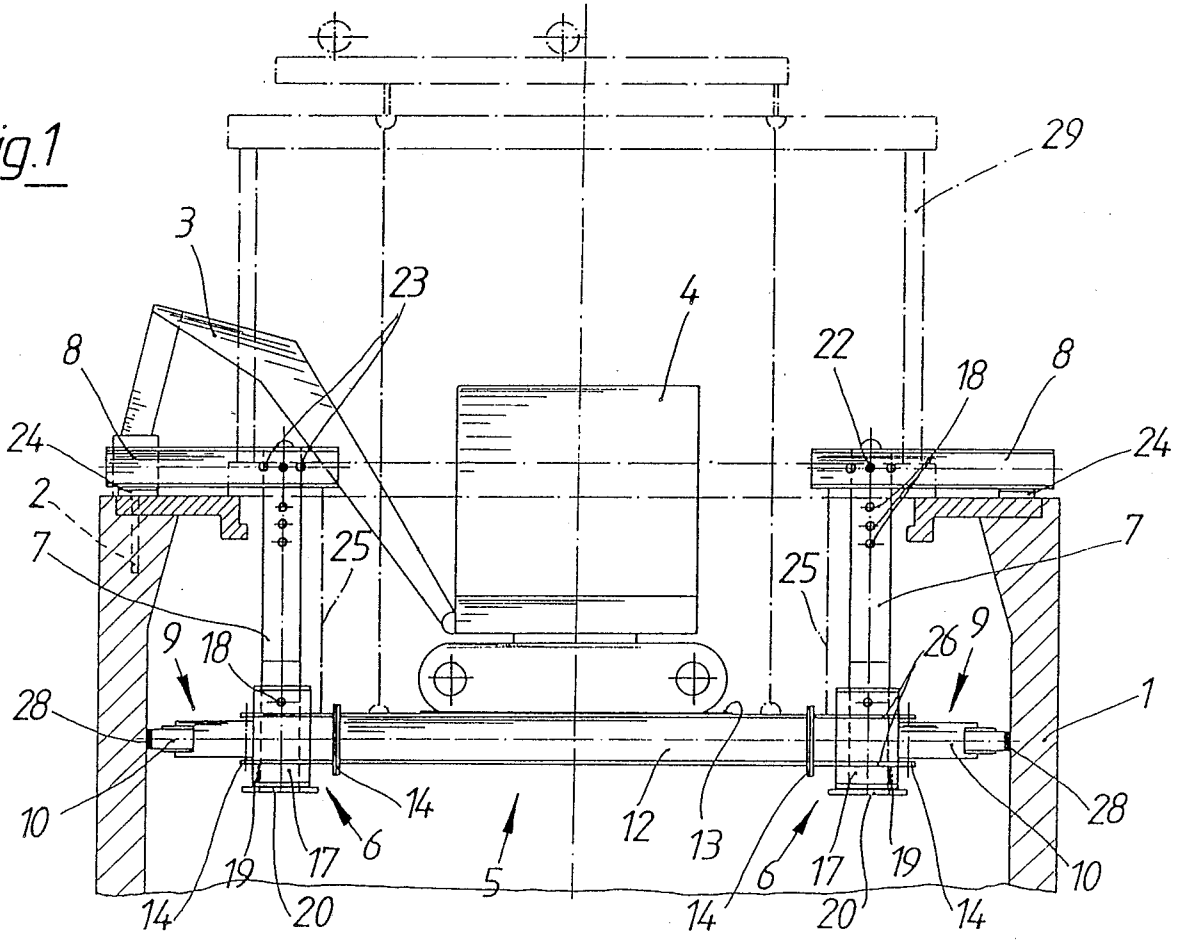
FIG. 1 is a schematic vertical sectional view of a smokestack opening with a hoist structure and a work platform suspended from the hoist structure.
Figure 2:
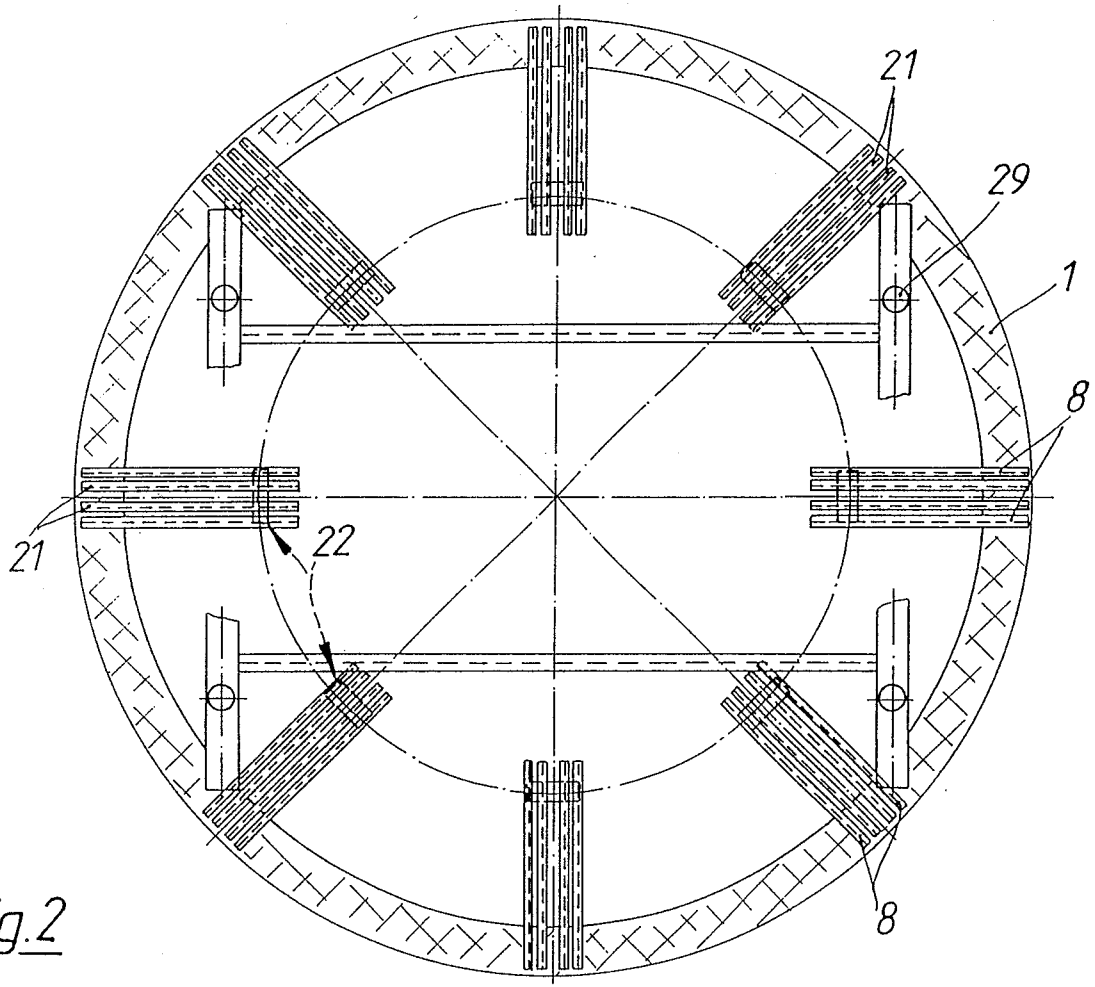
FIG. 2 is a schematic top view corresponding to FIG. 1, however, with the hoist structure shown in horizontal section and the work platform being indicated only schematically and shown without mechanical shovel.
Figure 5:
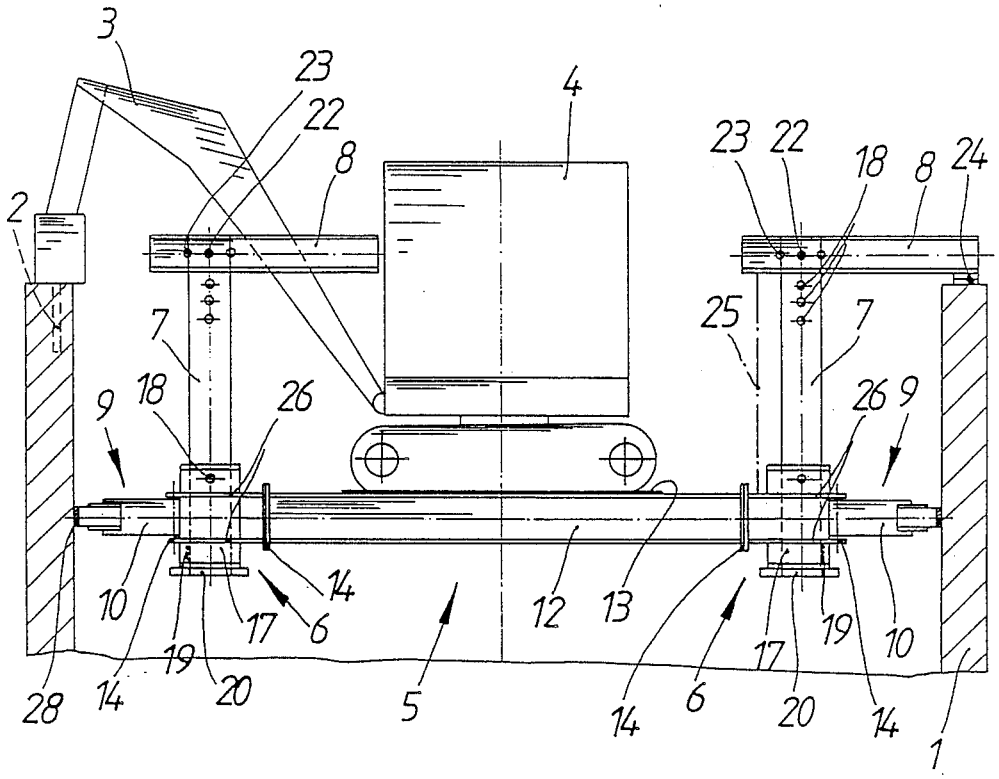
FIG. 5 is a vertical sectional view corresponding to FIG. 4 after the work platform has been lowered at the beginning of a new demolition cycle.

FIGS. 1-6 of the drawing show an arrangement for the demolition of smokestacks, particularly of free-standing smokestacks of great height, of masonry, concrete or reinforced concrete. The arrangement includes a demolition tool 2 for successively demolishing the smokestack shaft 1 from the smokestack head to the smokestack base. In the illustrated embodiment, the demolition tool 2 is attached to the boom of a mechanical shovel 4. A work platform 5 is suspended in the smokestack shaft 1 at the smokestack opening. The work platform 5 is suspended by means of suspension devices 6 which are distributed over the circumference of the work platform 5. Each suspension device 6 includes at least one vertically guided lowering piston 7 which can be locked in different vertical positions. A suspension arm 8 is mounted at the upper end of each piston and can be swung radially inwardly and outwardly. In the outwardly swung position, the suspension arm 8 engages over the smokestack wall.

The work platform 5 additionally has support devices 9 which are distributed over the circumference of the work platform 5. Each support device 9 includes a support arm 10 which can be moved into contact with the inner wall of the smokestack. The support devices 9 are connected in radial extension to the suspension devices 6. The suspension devices 6 and the support devices 9 can be moved forward or can be forepoled in radial direction by means of intermediately arranged cantilever arms 18. Thus, an adjustment to the smokestack diameter which increases from the smokestack head to the smokestack base is always possible.

In the illustrated embodiment, the work platform 5 has a polygonal circumference and is composed essentially of beamlike sectional girders 12 and a plate member 13 supported by the girders 12. The cantilever arms 7 are sectional girders with screwable connecting flanges 14. The work platform 5 and the suspension devices 6 also have such connecting flanges 14. Walkways 15 can be fastened on the cantilever arms 11. As only schematically illustrated in FIG. 6, catch nets 16 can be suspended from the cantilever arms 11.

Each suspension device 6 has a guide tube 17 which is flanged in vertical direction directly to the work platform 5 or to am intermediately arranged cantilever arm 11. A lowering piston 7 is mounted in each guide tube 17 so as to be vertically adjustable and lockable in different vertical positions. The guide tube 17 and the lowering piston 7 each have at predetermined vertical distances transverse bores 18 which are in alignment with each other and receive locking bolts. The guide tube 17 is a rectangular tube and the lowering piston 7 is an I-section. Roller guides 17 for the lowering piston 7 are arranged in the guide tube 17.

The lowering piston 7 has at its lower end a base plate 20 and suspension eyes at its upper end. In the lowered position, the work platform 5 rests on the base plates 20 of the lowering pistons 7. Each of the lowering pistons 7 has at its upper end two horizontal bearing jaws 21. The suspension arm 8 is pivotally mounted on a horizontal bearing bolt 22 between the bearing jaws 21. The suspension arm 8 is lockable in horizontal position by means of locking bolts which can be inserted in transverse bores 23 which are aligned on one side or on both sides of the bearing bolt 22. The suspension arm 8 is locked in the horizontal position when the suspension arm 8 engages over the smokestack wall and the work platform 5 is suspended by means of the intermediately arranged lowering piston 7. The bearing jaws 21 and the suspension arm 8 are U-sections. Each suspension arm 8 has at its end resting on the smokestack wall a vertically adjustable support plate 24 to provide an adjustment to the surface being demolished at a given time.

The inwardly facing ends of the suspension arms 8 and the guide tubes 17 in the region of the inner connecting flanges 14 are connected to each other through chain hoists or rope hoists 25. Thus, the work platform 5 can be lowered on the suspended lowering pistons 7 by means of chain hoist or rope hoist devices. Each guide tube 17 is surrounded by a double collar 26 with connecting flange 14. One or two support arms 10 are pivotally mounted in a horizontal plane in the double collar 26 or between the two collars and are fixable in a position in which they rest against the inner wall of the smokestack, for example, by means of a chain hoist 27 or a lever system which connects the two support arms. The support arms 10 are pivoted apart as the work platform 5 is lowered. The support arms 10 additionally have support plates 28 which are mounted pivotably or in an articulated manner to ensure a problem-free support relative to the inner wall of the smokestack.

The demolition of a smokestack is carried out by means of an arrangement according to the present invention as follows.

After the work platform 5 has been placed by means of a hoist structure 29 into the opening of the smokestack and a mechanical shovel 4 with a demolition tool 2 has been placed on the suspended work platform 5, the mechanical shovel 4 begins the demolition work in the area of a suspension arm 8 which has been swung back or inwardly. After demolition has been carried out over a predetermined vertical distance, which may not exceed the maximum piston stroke of the lowering piston 7, the respective suspension arm 8 is again swung into the initial position in which it engages over the smokestack wall. The respective lowering position 7 is now automatically in the retracted position. Subsequently, the demolition of the smokestack wall continues in the region of the next suspension arm 8 which is swung in and this procedure is carried out successively at all suspension arms 8, so that finally all lowering pistons 7 are retracted and the suspension arms 8 are swung into the position in which they engage over the smokestack wall. The support arms 10 are now loosened and swung apart, so that the work platform 5 can now be lowered on the lowering pistons 7 to the base plates 20.

A new demolition cycle is now carried out in the above-described manner. It is possible to carry out the demolition with a demolition progress over vertical distances which do not correspond to the maximum piston stroke of the lowering pistons 7 but only a fraction thereof, because the lowering pistons 7 inserted in the guide tubes 17 can be adjusted and locked by using the transverse bores 18 which are provided at predetermined vertical distances from each other. When the smokestack base has been reached, the lowering pistons 7 rest on the ground. The same is true for the work platform 5. As the work platform travels from the smokestack head to the smokestack base, cantilever arms 11 are used between the work platform 5 and the guide tubes 17 for the lowering pistons 7 with the support arms 10, so that the support arms 10 are always braced against the inner wall of the smokestack whose inner diameter increases and it is ensured that the work platform 5 is centered and is immovably supported.

Figure 6:
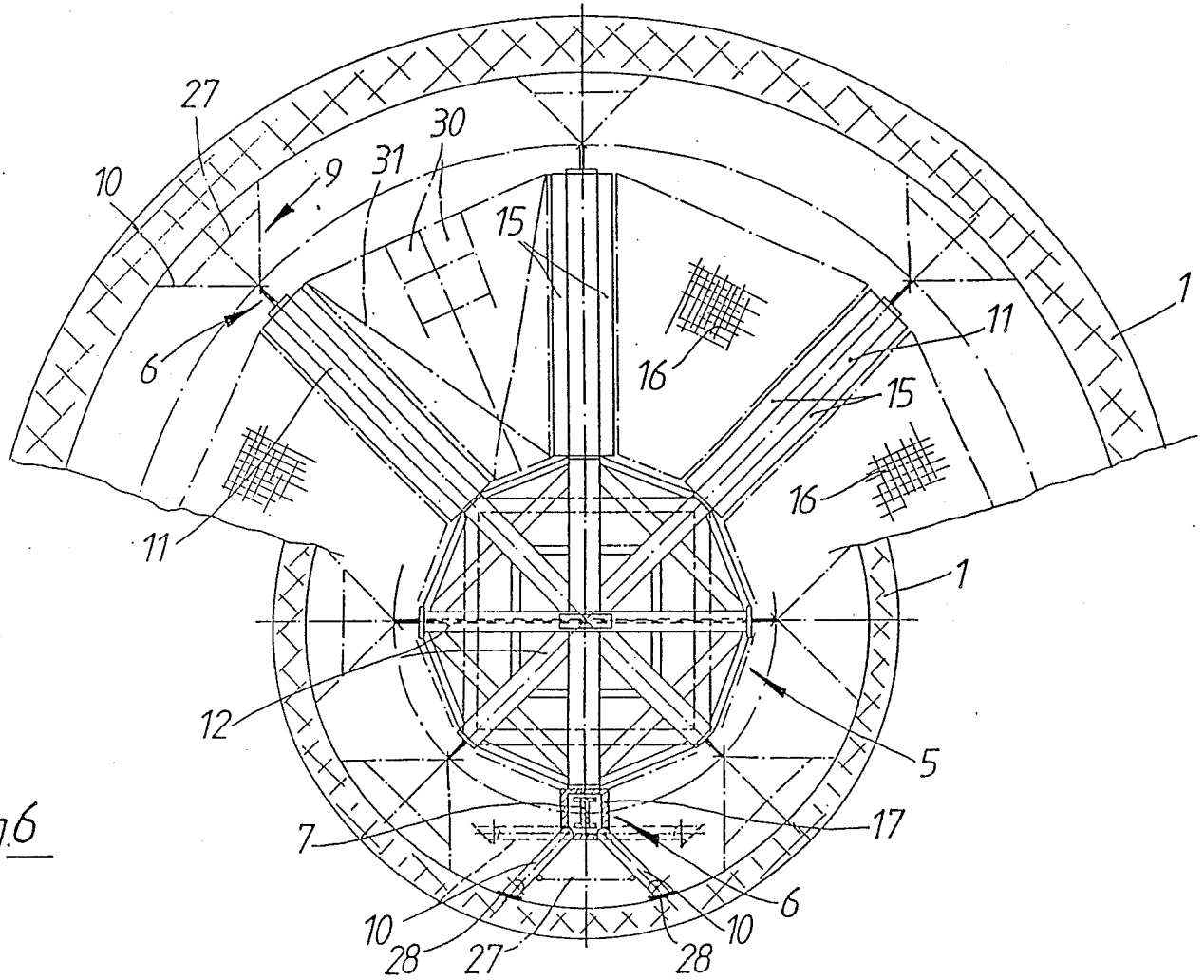
FIG. 6 is a schematic top view of a smokestack with a partial horizontal sectional view of an upper and a lower smokestack portion.

In accordance with another proposal of the invention, as schematically indicated in a portion of FIG. 6, a suspended structure 31 can be connected to the cantilever arms 11. Travel plates 30 are placed on the structure 31, so that the work platform 5 is extended into the region of the wall of the smokestack and the mechanical shovel 4 can travel from the center of the smokestack and can carry out demolition work by means of a demolition tool 2 which extends over the smokestack wall. In this case, no walkways and catch nets 16 are provided.

While a specific embodiment of the invention has been shown and described in detail to illustrate the application of the inventive principles, it will be understood that the invention may be embodied otherwise without departing from such principles.

I claim:

1. In an arrangement for the demolition of a smokestack, the smokestack having a wall forming a shaft, a smokestack head and a smokestack base, the arrangement including a demolition tool for successively demolishing the smokestack shaft from the head to the base of the smokestack, the improvement comprising a work platform to be placed into the smokestack shaft at the head thereof, the work platform having a circumference, the work platform including a plurality of suspension devices which are distributed over the circumference of the work platform, each suspension device including at least one lowering piston, means for vertically guiding and locking the lowering piston, the lowering piston having an upper end, the suspension device further including a suspension arm, the suspension arm being mounted at the upper end of the lowering piston so as to be swingable between an inwardly swung position and an outwardly swung position, the suspension arm engaging over the smokestack wall in the outwardly swung position.

2. The arrangement according to claim 1, wherein the work platform comprises support devices distributed over the circumference of the work platform, each support device having a support arm adapted to be placed into contact with the wall of the smokestacks.

3. The arrangement according to claim 2, wherein the support devices are arranged in radial extension to the suspension devices, cantilever arms attached to the work platform and the suspension devices, the suspension devices and the support devices being movable in radial direction by means of the cantilever arms.

4. The arrangement according to claim 3, wherein each cantilever arm is a sectional girder with a screwable connecting flange.

5. The arrangement according to claim 3, wherein each cantilever arm is a rack and pinion gear system with a screwable connecting flange.

6. The arrangement according to claim 3, wherein each cantilever arm is a cylinder piston arrangement with a screwable connecting flange.

7. The arrangement according to claim 3, comprising walkways mounted on the cantilever arms.

8. The arrangement according to claim 3, comprising catch nets mounted between the cantilever arms.

9. The arrangement according to claim 3, wherein each suspension device comprises a guide tube, the guide tube being flanged in vertical alignment to one of the work platform and the cantilever arm, the lowering piston being vertically adjustably mounted in the guide tube, the guide tube and the lowering piston each having at predetermined vertical distances aligned transverse bores for the insertion of locking bolts.

10. The arrangement according to claim 9, wherein the guide tube is a rectangular tube and the lowering piston is a I-section, longitudinal guide means for the lowering piston being mounted in the guide tube.

11. The arrangement according to claim 10, wherein the longitudinal guide means comprises ball guides.

12. The arrangement according to claim 10, wherein the longitudinal guide means comprises roller guides.

13. The arrangement according to claim 1, wherein the lowering piston has a lower end, a base plate being attached to the lower end of the lowering piston, and suspension eyes being provided at the upper end of the lowering piston.

14. The arrangement according to claim 1, comprising two horizontal bearing jaws mounted at the upper end of the lowering piston, the suspension arm being pivotally mounted on a bearing bolt between the bearing jaws, and a locking bolt for locking the suspension arm 8 in horizontal position, the locking bolt being insertable in transverse bores provided laterally of the bearing bolt.

15. The arrangement according to claim 14, wherein the bearing jaws and the suspension arms are U-sections.

16. The arrangement according to claim 1, wherein and end of each suspension arm resting on the smokestack wall has a vertically adjustable support plate.

17. The arrangement according to claim 9, wherein the suspension arms and the guide tubes have radially inwardly facing ends, the inwardly facing ends being connected to each other by means of chain hoists or rope hoists, whereby the work platform is lowerable on the suspended lowering pistons.

18. The arrangement according to claim 9, comprising double collars surrounding each guide tube with connecting flange, two support arms being mounted between the double collars so as to be pivotable in a horizontal plane and fixable in a position resting against the wall of the smokestack.

19. The arrangement according to claim 18, wherein the two support arms are fixable by means of a chain hoist.

20. The arrangement according to claim 18, wherein two support arms are fixable by means of a lever system.

21. The arrangement according to claim 18, wherein the support arms have at the ends thereof pivotably mounted support plates.

22. The arrangement according to claim 18, wherein the support arms have at the ends thereof support plates which are mounted in an articulated manner.

23. The arrangement according to claim 9, comprising a suspended structure attached to each cantilever arm, travel plates being placed on the suspended structure.

* * * * *